US007815423B2

(12) United States Patent
Guo et al.

(10) Patent No.: US 7,815,423 B2
(45) Date of Patent: Oct. 19, 2010

(54) COMPRESSOR WITH FLUID INJECTION SYSTEM

(75) Inventors: Huaming Guo, Suzhou (CN); Wayne Li, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 11/494,270

(22) Filed: Jul. 27, 2006

(65) Prior Publication Data

US 2007/0183915 A1 Aug. 9, 2007

Related U.S. Application Data

(60) Provisional application No. 60/704,055, filed on Jul. 29, 2005.

(51) Int. Cl.
*F01C 1/02* (2006.01)

(52) U.S. Cl. ..... 418/55.1; 418/55.5

(58) Field of Classification Search ..... 418/55.1–55.6
See application file for complete search history.

(56) References Cited

U.S. PATENT DOCUMENTS

| | | | | |
|---|---|---|---|---|
| 5,211,031 | A | 5/1993 | Murayama et al. | |
| 5,253,489 | A | 10/1993 | Yoshii | |
| 5,329,788 | A | 7/1994 | Caillat et al. | |
| 5,447,420 | A | 9/1995 | Caillat et al. | |
| 5,469,716 | A | 11/1995 | Bass et al. | |
| 5,640,854 | A | 6/1997 | Fogt et al. | |
| 6,017,205 | A | 1/2000 | Weatherston et al. | |
| 6,042,344 | A | 3/2000 | Lifson | |
| 6,053,715 | A | 4/2000 | Hirano et al. | |
| 6,089,839 | A | 7/2000 | Bush et al. | |
| 6,106,253 | A | 8/2000 | Sakai et al. | |
| 6,142,753 | A | 11/2000 | Bush et al. | |
| 6,162,033 | A | 12/2000 | Moore, Jr. et al. | |
| 6,213,731 | B1 * | 4/2001 | Doepker et al. | 417/310 |
| 6,293,776 | B1 * | 9/2001 | Hahn et al. | 418/55.6 |
| 6,350,111 | B1 * | 2/2002 | Perevozchikov et al. | 417/440 |
| 6,619,936 | B2 | 9/2003 | Perevozchikov | |
| 6,672,846 | B2 * | 1/2004 | Rajendran et al. | 417/410.5 |
| 6,679,683 | B2 * | 1/2004 | Seibel et al. | 417/213 |
| 6,773,242 | B1 * | 8/2004 | Perevozchikov | 418/55.2 |
| 7,074,013 | B2 * | 7/2006 | Seibel et al. | 417/213 |
| 7,201,567 | B2 * | 4/2007 | Wiertz et al. | 417/410.5 |

(Continued)

OTHER PUBLICATIONS

International Preliminary Report on Patentability for International Application No. PCT/US2006/029706.

(Continued)

*Primary Examiner*—Thomas Denion
*Assistant Examiner*—Douglas J. Duff
(74) *Attorney, Agent, or Firm*—Harness, Dickey & Pierce, P.L.C.

(57) ABSTRACT

A scroll compressor includes a housing, a non-orbiting scroll member including a first spiral wrap, and an orbiting scroll member including a second spiral wrap. The first and second spiral wraps are interleaved to define at least one moving fluid pocket that decreases in size as it moves from a radially outer position to a radially inner position. A vapor-injection system may include a shell fitting in fluid communication with a fluid passageway of the non-orbiting scroll member via a vapor injection tube. The vapor injection tube may be fixed for movement with the non-orbiting scroll member for communicating vapor into the moving fluid pockets.

65 Claims, 11 Drawing Sheets

U.S. PATENT DOCUMENTS

| | | | | |
|---|---|---|---|---|
| 7,228,710 | B2 * | 6/2007 | Lifson | 62/513 |
| 7,278,832 | B2 * | 10/2007 | Lifson et al. | 417/310 |
| RE40,554 | E | 10/2008 | Bass et al. | |
| 2003/0012659 | A1 * | 1/2003 | Seibel et al. | 417/213 |
| 2003/0133819 | A1 * | 7/2003 | Perevozchikov | 418/55.2 |
| 2004/0081562 | A1 * | 4/2004 | Seibel et al. | 417/213 |
| 2006/0269432 | A1 * | 11/2006 | Lifson | 418/55.1 |
| 2007/0059193 | A1 | 3/2007 | Maladkar et al. | |
| 2007/0183915 | A1 | 8/2007 | Guo et al. | |
| 2008/0107555 | A1 | 5/2008 | Lifson | |
| 2008/0152526 | A1 | 6/2008 | Perevozchikov et al. | |
| 2008/0236179 | A1 | 10/2008 | Ignatiev et al. | |
| 2008/0256961 | A1 | 10/2008 | Lifson et al. | |
| 2008/0314057 | A1 | 12/2008 | Lifson et al. | |

OTHER PUBLICATIONS

First Office Action issued by the Chinese Patent Office on Jun. 5, 2009 regarding Application No. 200680032734.1, translated by CCPIT Patent and Trademark Law Office.

* cited by examiner

COMPRESSOR WITH FLUID INJECTION SYSTEM

CROSS-REFERENCE TO RELATED APPLICATIONS

This application claims the benefit of U.S. Provisional Application No. 60/704,055, filed on Jul. 29, 2005. The disclosure of the above application is incorporated herein by reference.

FIELD

The present teachings relate to compressors, and more particularly, to an improved vapor-injection system for use with a compressor.

BACKGROUND AND SUMMARY

Scroll machines are becoming increasingly popular for use as compressors in refrigeration and HVAC systems due to their capability for extremely efficient operation. Generally, scroll machines include an orbiting scroll member intermeshed with a non-orbiting scroll member to define series of compression chambers. Rotation of the orbiting scroll member relative to the non-orbiting scroll member causes the compression chambers to progressively decrease in size and cause a fluid disposed within each chamber to be compressed.

The non-orbiting scroll member seals against the orbiting scroll member to achieve compression. However, slight movement of the non-orbiting scroll member relative to the orbiting scroll member is typically permitted to account for forces acting on the non-orbiting scroll member during compression and during specific fault conditions such as liquid entering the compression chamber.

During operation, the orbiting scroll member orbits relative to the non-orbiting scroll member causing fluid to be compressed within the compression chambers. Compression of the fluid causes a force to be applied to the non-orbiting and orbiting scroll members, urging separation of the non-orbiting scroll member and the orbiting scroll member. The orbiting scroll member is conventionally attached to a motor via a driveshaft and, as such, is not permitted to axially move relative to the non-orbiting scroll member. Therefore, the non-orbiting scroll member should be able to axially move relative to the orbiting scroll member during compression to accommodate certain forces applied during compression.

Vapor injections systems may be used with scroll machines to improve efficiency. Vapor-injection systems typically extract vapor at an intermediate pressure, which is somewhat higher than suction pressure and somewhat lower than discharge pressure, and inject the extracted vapor into a compression chamber to lessen the work required to output vapor at discharge pressure.

Vapor may be introduced to a compression chamber through the non-orbiting scroll member. A conduit may extend from an external economizer heat exchanger or flash tank to the scroll machine and through the non-orbiting scroll member. The conduit may accommodate axial movement of the non-orbiting scroll member during compression to avoid damage to the conduit.

Conventional vapor-injection systems often require the conduit to extend through a top portion of the scroll machine, which necessitates extending the conduit through a discharge chamber of the scroll machine and therefore requires multiple seals. Furthermore, positioning the conduit through the top portion of the scroll machine requires precise positioning of the passage through the top potion of the scroll machine and a partition defining the discharge chamber from the suction chamber to ensure proper alignment between the conduit and the non-orbiting scroll member.

The present teachings provide a scroll compressor including a housing, a non-orbiting scroll member including a first spiral wrap, and an orbiting scroll member including a second spiral wrap. The first and second spiral wraps are interleaved to define at least one moving fluid pocket that decreases in size as it moves from a radially outer position to a radially inner position. A vapor-injection system may include a shell fitting in fluid communication with a fluid passageway of the non-orbiting scroll member via a vapor injection tube. The vapor injection tube may be fixed for movement with the non-orbiting scroll member for communicating vapor into the moving fluid pockets.

BRIEF DESCRIPTION OF THE DRAWINGS

The present teachings will become more fully understood from the detailed description and the accompanying drawings, wherein.

DETAILED DESCRIPTION

The following description is merely exemplary in nature and is in no way intended to limit the teachings, application, or uses.

Figure 1A:
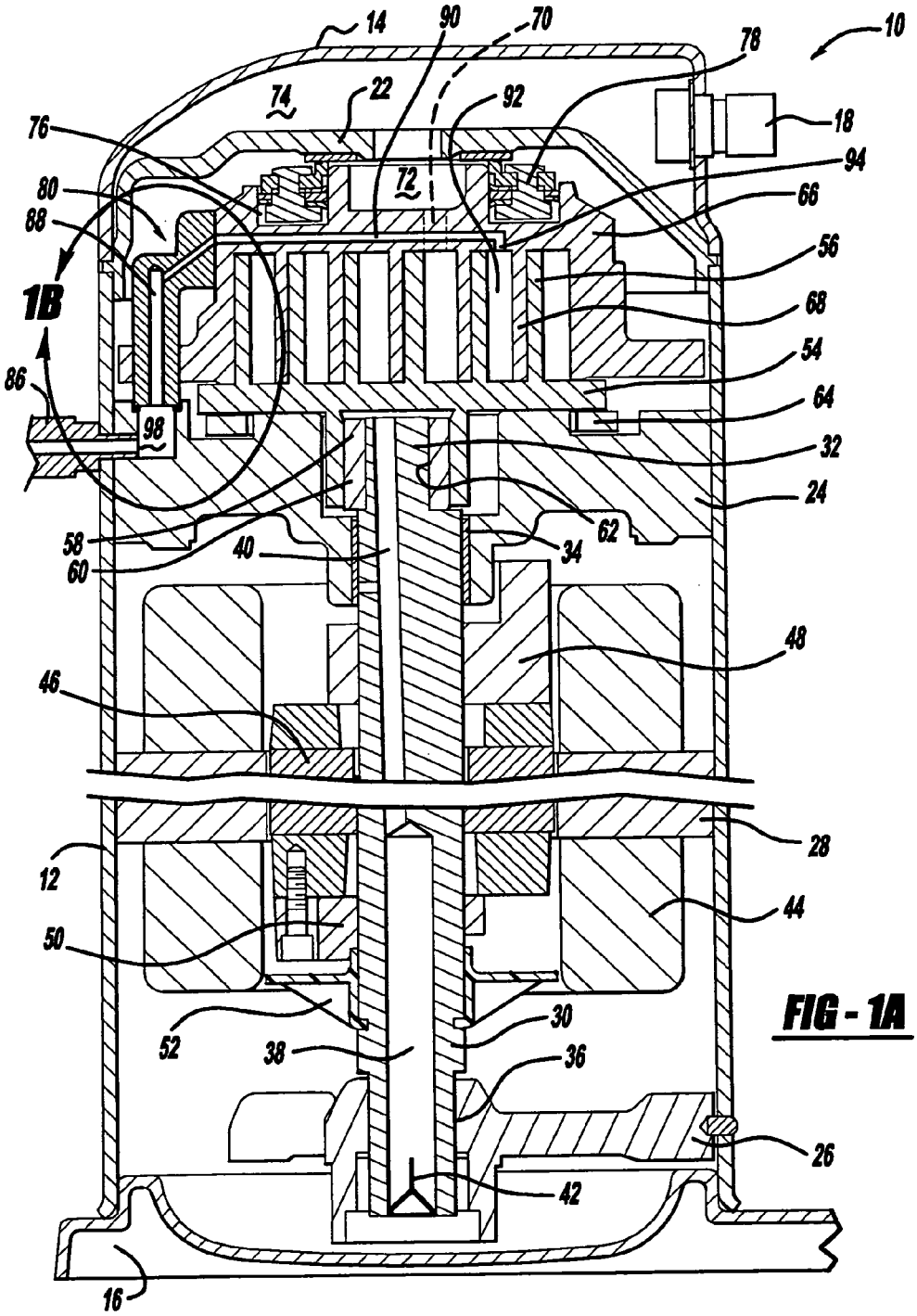
FIG. 1A is a cross-sectional view of a compressor incorporating a vapor-injection system in accordance with the principles of the present teachings.

With reference to FIG. 1A, a scroll compressor 10 is provided and includes a generally cylindrical hermetic shell 12 having a cap 14 welded at the upper end thereof and a base 16 welded at the lower end thereof. The base 16 may include a plurality of mounting feet (not shown). Cap 14 is provided with a refrigerant discharge fitting 18, which may have a discharge valve therein (not shown). The shell 12 may include a transversely extending partition 22, which is welded about its periphery at approximately the same point that cap 14 is welded to shell 12, a stationary main bearing housing or body 24, which is secured to shell 12, and a lower bearing housing 26 also having a plurality of radially outwardly extending legs, each of which is also secured to shell 12. A motor stator 28, which is generally square in cross-section but with the corners rounded off, may be press fit into shell 12. The flats between the rounded corners on the stator 28 provide passageways between the stator 28 and shell 12, which facilitate the flow of lubricant from the top of shell 12 to the bottom.

A drive shaft or crankshaft 30 having an eccentric crank pin 32 at the upper end thereof is rotatably journaled in a first bearing 34 in main bearing housing 24 and a second bearing 36 in lower bearing housing 26. Crankshaft 30 has at the lower end a relatively large diameter concentric bore 38, which communicates with a radially outwardly inclined smaller diameter bore 40 extending upwardly therefrom the top of crankshaft 30. Disposed within bore 38 is a lubricant flinger 42. The lower portion of the interior shell 12 is filled with lubricating oil, and bore 38 in conjunction with lubricant flinger 42 acts as a pump to move lubricating fluid up bore 38 in crankshaft 30 and into bore 40. Movement of oil within bore 38 ultimately supplies oil to each of the various portions of the compressor 10 that require lubrication. Lubricant flinger 42 is preferably of the type disclosed in Assignee's U.S. application Ser. No. 10/925,648 filed on Aug. 25, 2004, the disclosure of which is incorporated herein by reference.

Crankshaft 30 is rotatively driven by an electric motor including stator 28, windings 44 passing therethrough, and a rotor 46 press fit on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor", the disclosure of which is incorporated herein by reference.

The upper surface of main bearing housing 24 is provided with a flat thrust bearing surface on which is disposed an orbiting scroll member 54 having a spiral vane or wrap 56 on the upper surface thereof. Projecting downwardly from the lower surface of orbiting scroll member 54 is a cylindrical hub having a journal bearing 58 therein and in which is rotatively disposed a drive bushing 60 having an inner bore 62 in which crank pin 32 is drivingly disposed. Crank pin 32 has a flat on one surface that drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll member 54 and bearing housing 24 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506, the disclosure of which is hereby incorporated herein by reference, may be used in place thereof.

A non-orbiting scroll member 66 is also provided having a wrap 68 positioned in meshing engagement with wrap 56 of orbiting scroll member 54. Non-orbiting scroll member 66 has a centrally disposed discharge passage 70 communicating with an upwardly open recess 72, which is in fluid communication with a discharge chamber 74 defined by cap 14 and partition 22. An annular recess 76 is also formed in non-orbiting scroll member 66 within which is disposed a seal assembly 78. Recesses 72 and 76 and seal assembly 78 cooperate to define axial pressure biasing chambers that receive pressurized fluid being compressed by wraps 56 and 68 so as to exert an axial biasing force on non-orbiting scroll member 66 to thereby urge the tips of respectively wraps 56, 68 into sealing engagement with the opposed end plate surfaces. Seal assembly 78 is preferably of the type described in greater detail in Assignee's U.S. Pat. No. 5,156,539, the disclosure of which is hereby incorporated herein by reference. Non-orbiting scroll member 66 is mounted with limited axial movement with respect to bearing housing 24 in a suitable manner such as disclosed in the aforementioned U.S. Pat. No. 4,877,382 or U.S. Pat. No. 5,102,316, the disclosure of which is hereby incorporated herein by reference.

Figure 1B:
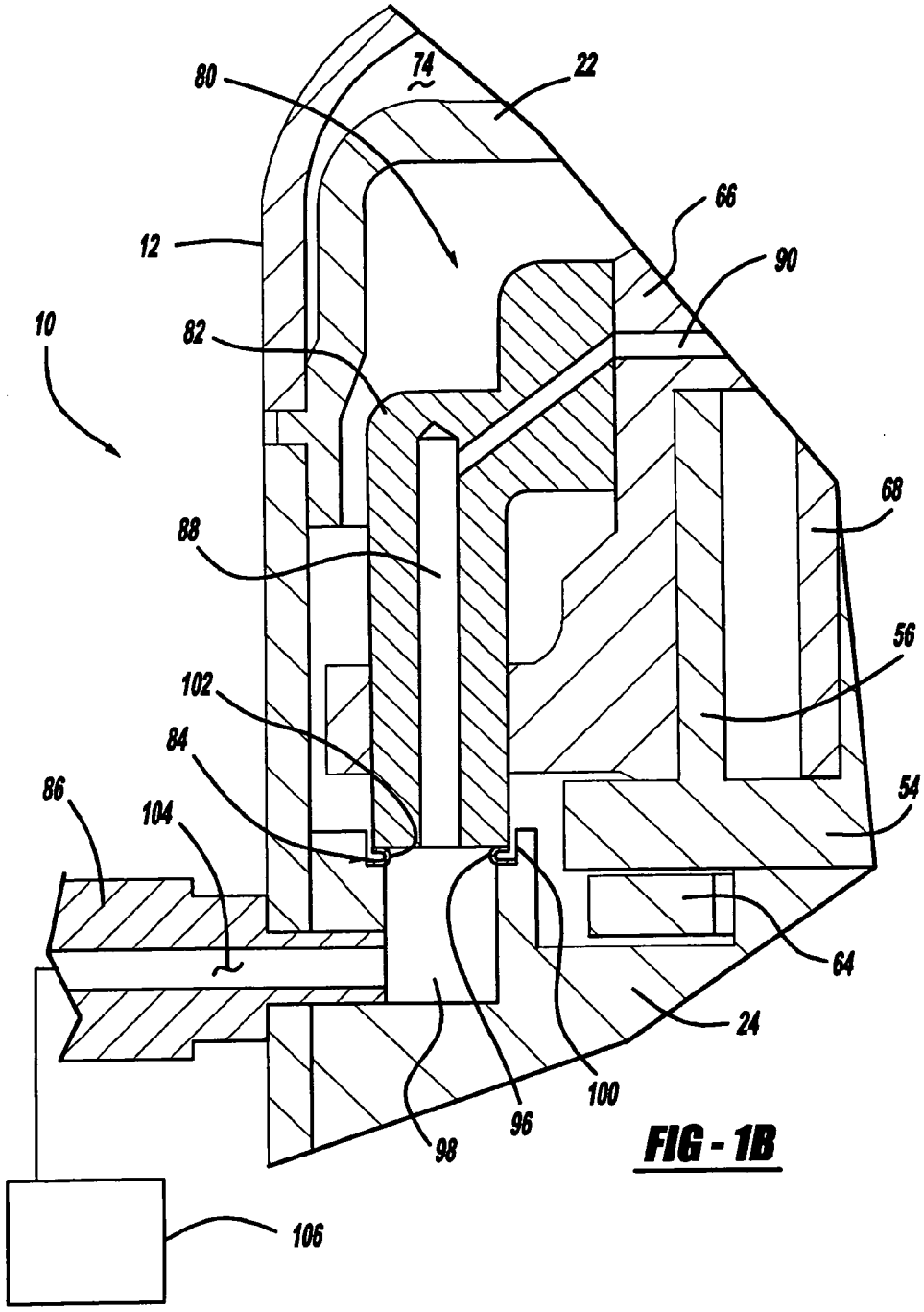
FIG. 1B is a more detailed view of the vapor-injection system of FIG. 1A.
Figure 2:
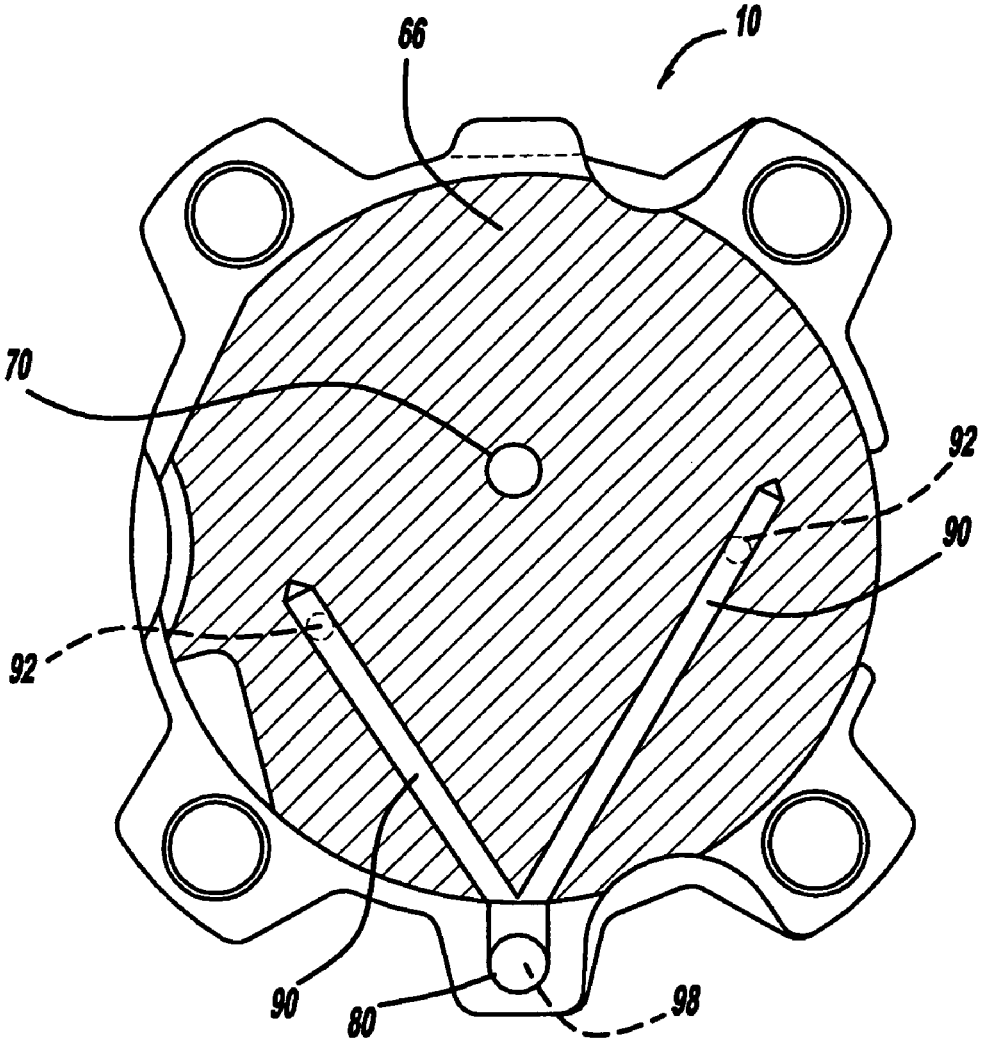
FIG. 2 is a cross-sectional view of a non-orbiting scroll member of the compressor of FIG. 1A.

With particular reference to FIGS. 1A, 1B, and 2, a vapor-injection system 80 is shown incorporated into the compressor 10. The vapor-injection system 80 may be fluidly coupled to an external system such as, but not limited to, an economizer heat exchanger or flash tank 106 to supply vapor to the compressor 10 at an "intermediate" pressure. Vapor at intermediate pressure may be at a pressure somewhere between discharge pressure and suction pressure. Supplying vapor to compressor 10 at intermediate pressure reduces the work required by the motor to fully compress the vapor and thus, reduces energy consumption.

Vapor-injection system 80 may include a vapor injection tube 82, a seal assembly 84, and a shell fitting 86. Tube 82 may be fixedly connected to non-orbiting scroll member 66 and includes a passageway 88. Passageway 88 may be fluidly coupled to a passageway 90 formed in non-orbiting scroll member 66. Vapor introduced to tube 82 may be piped through non-orbiting scroll member 66 via passageways 88, 90 and injected into a pocket 92 defined by wraps 56, 68 of orbiting and non-orbiting scroll members 54, 66, respectively, at an injection port 94 formed through non-orbiting scroll member 66.

Seal assembly 84 may include a flat-top seal arrangement having a compressible gasket 96 disposed generally between tube 82 and main bearing housing 24. Main bearing housing 24 may include a bore 98 formed therein having a shelf 100. Gasket 96 of the flat-top seal arrangement is seated within bore 98 on shelf 100. Tube 82 is positioned within bore 98 such that an end 102 of tube 82 is in engagement with gasket 96. Relative engagement between tube 82 and main bearing housing 24 via gasket 96 maintains communication between passageway 88 and bore 98 when tube 82 moves axially or radially relative to bore 98 through main bearing housing 24.

Non-orbiting scroll member 66 may move relative to main bearing housing 24 due to forces associated with compression. Such movement of non-orbiting scroll member 66 does not separate tube 82 from main bearing housing 24 due to interaction between tube 82, gasket 96, and shelf 100. For example, if non-orbiting scroll member 66 separates axially from orbiting scroll member 54, passageway 88 maintains sealed fluid communication with bore 98 because gasket 96 expands to maintain contact with end 102 of tube 82 and self 100 of main bearing housing 24. Conversely, when the non-orbiting scroll member 66 is in sealing engagement with the orbiting scroll member 54 via the respective wrap tips, tube 82 compresses gasket 96 to accommodate the axial movement and fluid communication between passageway 88 and bore 98 is maintained. Similarly, when non-orbiting scroll member 66 moves radially relative to orbiting scroll member 54, tube 82 moves radially within bore 98 to allow transverse movement of tube 82 relative main bearing housing 24 and maintains fluid communication between passageway 88 and bore 98.

Vapor-injection system 80 provides vapor to pocket 92 through non-orbiting scroll member 66 without having to extend a vapor conduit through cap 14 and discharge chamber 74, thereby reducing the number of seals and providing a reliable manufacturing process. Piping a conduit through cap 14 requires alignment of apertures through cap 14 and partition plate 22 with a passageway through non-orbiting scroll member 66, which increases manufacturing cost and complexity. The manufacturing process is further improved because non-orbiting scroll member 66 is properly aligned with main bearing housing 24 to ensure a proper seal between wraps 56, 68 of orbiting and non-orbiting scroll members 54, 66, respectively. Therefore, fixing tube 82 to non-orbiting scroll member 66 ensures proper alignment of tube 82 with bore 98 of main bearing housing 24 without additional manufacturing complexities.

Shell fitting 86 is fixedly attached to shell 12 of compressor 10 and includes a passageway 104 in fluid communication with bore 98 of main bearing housing 24. Shell fitting 86 allows vapor-injection system 80 to be in fluid communication with an external system such as economizer heat exchanger or flash tank 106 to provide compressor 10 with vapor at intermediate pressure. While an economizer heat exchanger or flash tank 106 are described, it should be understood that any system capable of providing vapor-injection system 80 with vapor at intermediate pressure should be considered within the scope of the present teachings.

In operation, vapor-injection system 80 provides vapor at intermediate pressure from economizer heat exchanger or flash tank 106 to shell fitting 86, which communicates the vapor via passageway 104 to bore 98 through main bearing housing 24. Vapor moves through bore 98 into passageway 88 of tube 82, which communicates the vapor to passageway 90 through non-orbiting scroll member 66. Vapor is injected into pocket 92 at port 94, which is located at the end of passageway 90. The intermediate-pressure vapor decreases the amount of work required by the motor in fully compressing the vapor and therefore increases the overall efficiency of compressor 10.

Figure 3A:
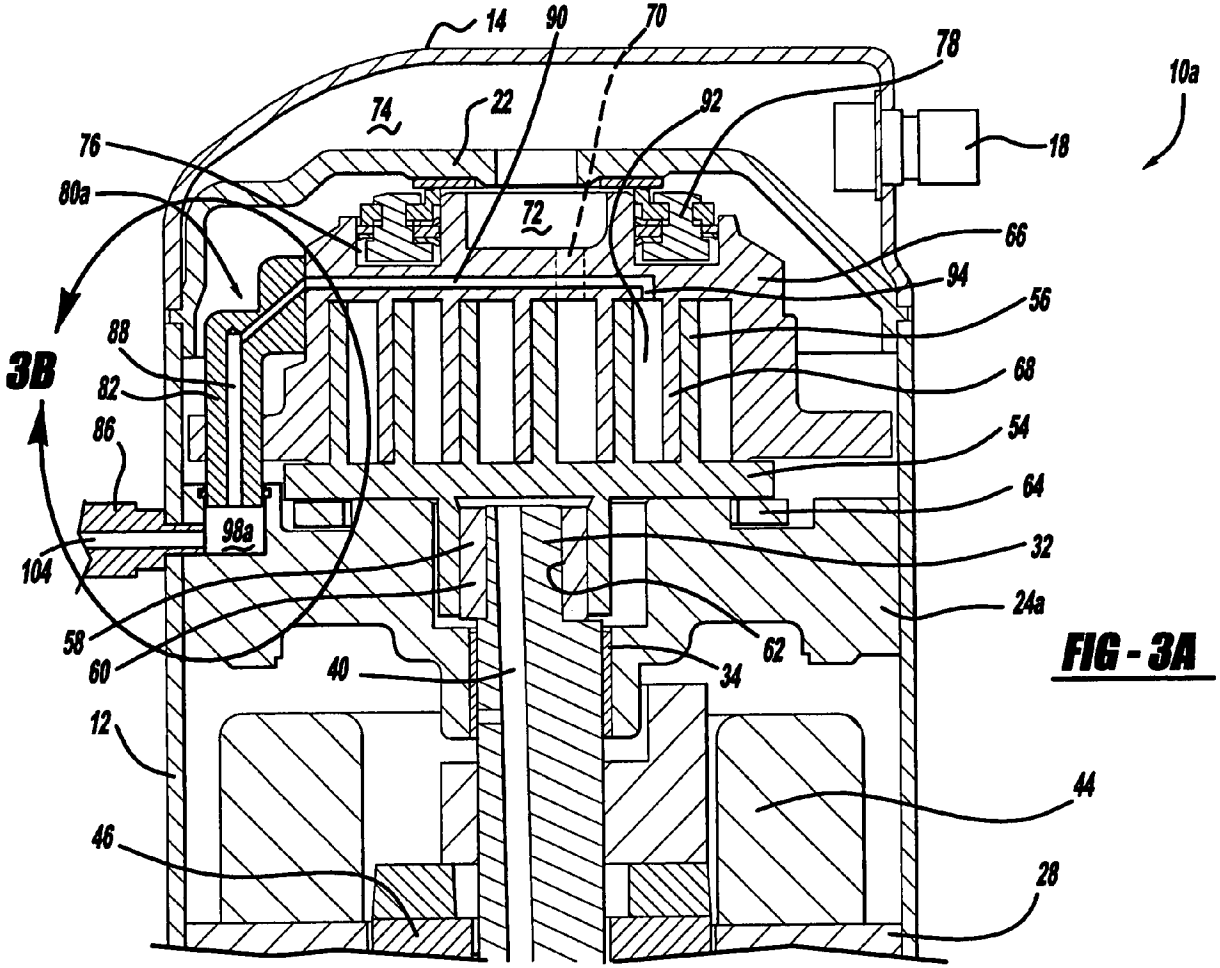
FIG. 3A is a cross-sectional view of a compressor incorporating a vapor-injection system in accordance with the principles of the present teachings.
Figure 3B:
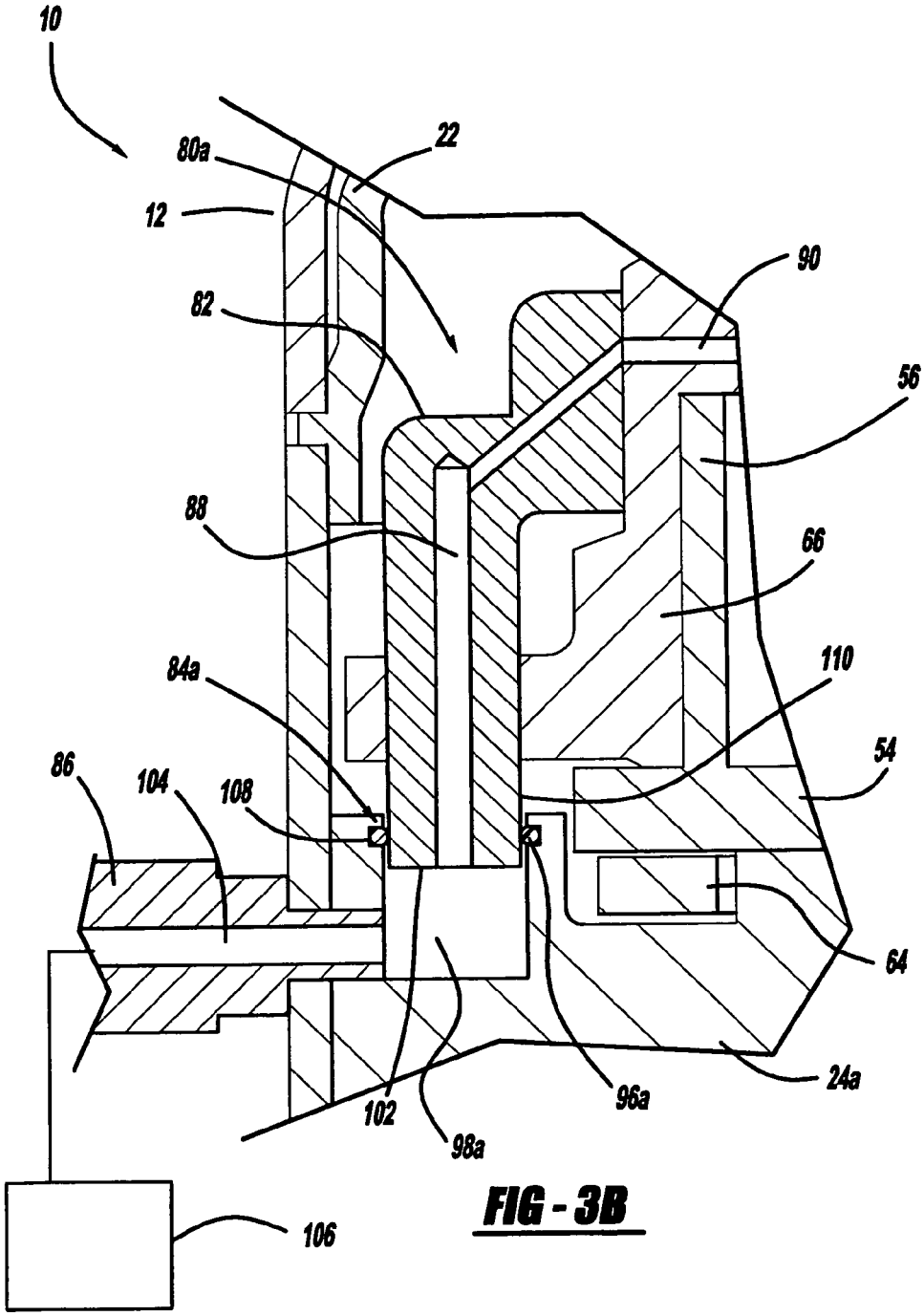
FIG. 3B is a more detailed view of the vapor-injection system of FIG. 3A.

With particular reference to FIGS. 3A and 3B, a vapor-injection system 80*a* is provided. In view of the general similarity in structure and function of the components associated with vapor-injection system 80 with respect to vapor-injection system 80*a*, like reference numerals are used hereinafter and in the drawings to identify like components while like reference numerals containing letter extensions are used to identify those components that have been modified.

Vapor-injection system 80*a* includes a vapor injection tube 82 having a passageway 88, a seal assembly 84*a*, and a shell fitting 86. Tube 82 is fixed to non-orbiting scroll member 66 such that passageway 88 is in fluid communication with passageway 90 and port 94. Passageway 88 is also in fluid communication with a bore 98*a* of main bearing housing 24*a* to allow bore 98*a* to be in fluid communication with non-orbiting scroll member 66.

Seal assembly 84*a* is generally disposed between tube 82 and a portion of main bearing housing 24*a* defining bore 98*a* to maintain fluid communication therebetween when non-orbiting scroll member 66 is caused to move axially or radially relative to orbiting scroll member 54. Seal assembly 84*a* includes a gasket 96*a* disposed in an axial recess 108 of bore 98*a*. Gasket 96*a* is in sealing engagement with an external surface 110 of tube 82 and may be any suitable seal such as, but not limited to, a rubber O-ring and the like. Bore 98*a* is in fluid communication with a passageway 104 of shell fitting 86 to allow intermediate-pressure vapor to enter compressor 10*a* from economizer heat exchanger or flash tank 106.

In operation, non-orbiting scroll member 66 may be caused to move axially and/or transverse relative to orbiting scroll member 54 due to forces associated with compression. Gasket 96*a* allows tube 82 to move axially with non-orbiting scroll member 66 and still maintain a sealed relationship between passageway 88 of tube 82 and bore 98*a* of main bearing housing 24*a*. For example, if non-orbiting scroll member 66 is caused to axially move relative to main bearing housing 24*a* due to axial movement of non-orbiting scroll member 66 relative to orbiting scroll member 54, gasket 96*a* maintains engagement with surface 110 of tube 82 as tube 82 moves axially within bore 98*a* to ensure that passageway 88 remains in a sealed relationship with bore 98*a* of main bearing housing 24*a*. Therefore, during axial movement of non-orbiting scroll member 66 relative to orbiting scroll member 54, intermediate-pressure vapor may still be delivered to pocket 92 via shell fitting 86, bore 98*a*, tube 82, passageway 90, and port 94.

Gasket 96*a* also allows radial movement of tube 82 relative to bore 98*a* of main bearing housing 24*a* to accommodate radial movement of non-orbiting scroll member 66 relative to orbiting scroll member 54. During such movement, gasket 96*a* is compressed by the transverse movement of tube 82 but still maintains a seal between tube 82 and main bearings housing 24*a*.

Figure 4A:
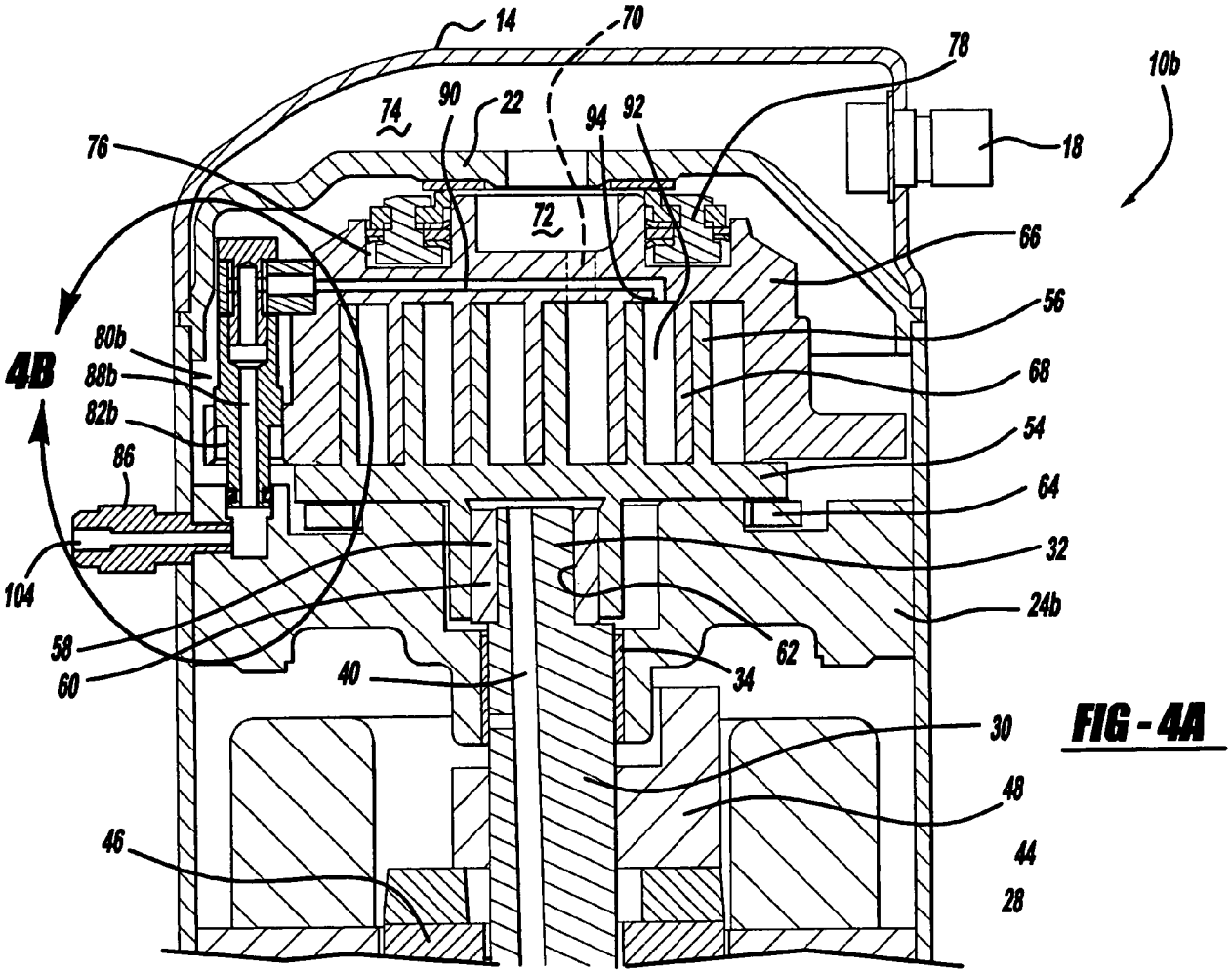
FIG. 4A is a cross-sectional view of a compressor incorporating a vapor-injection system in accordance with the principles of the present teachings.
Figure 4B:
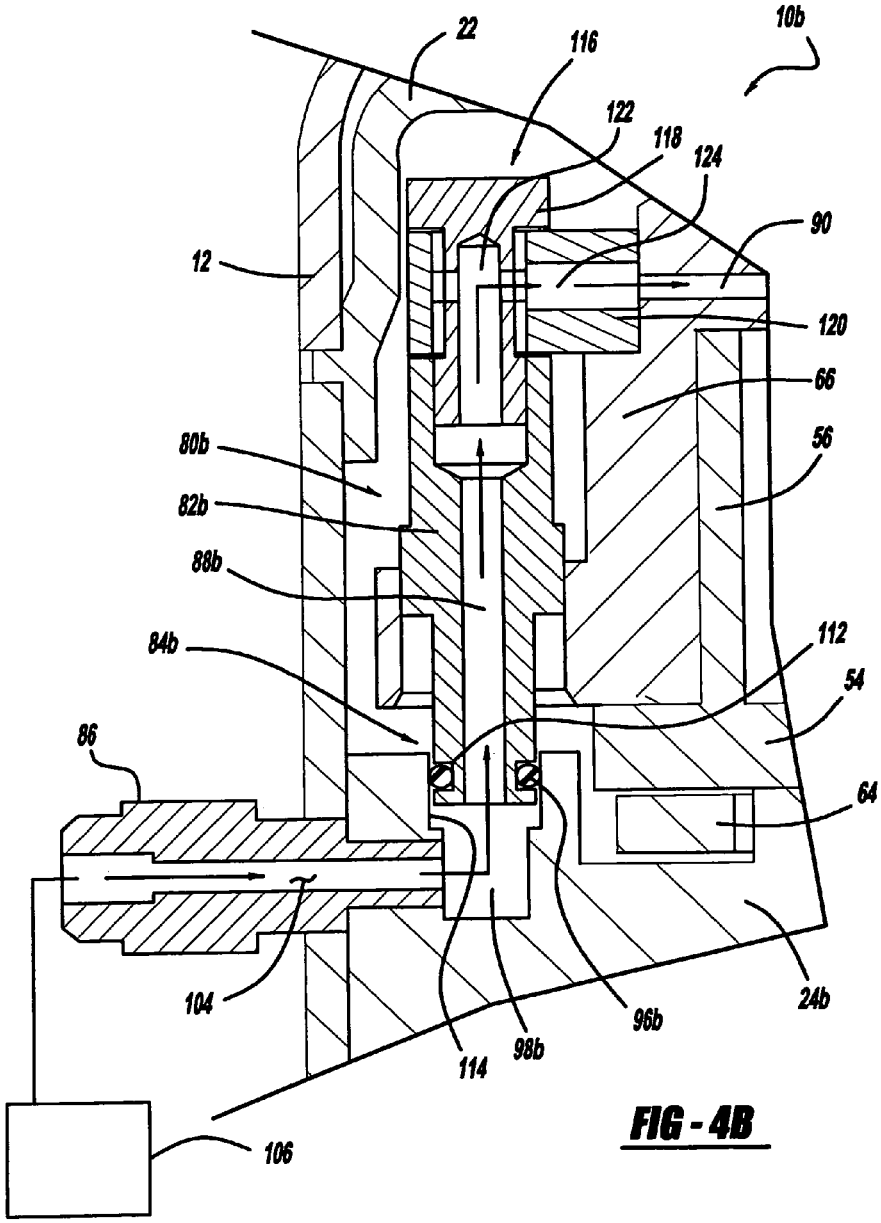
FIG. 4B is a more detailed view of the vapor-injection system of FIG. 4A.

With particular reference to FIGS. 4A and 4B, a vapor-injection system 80*b* is provided. In view of the general similarity in structure and function of the components associated with vapor-injection system 80 with respect to vapor-injection system 80*b*, like reference numerals are used hereinafter and in the drawings to identify like components while like reference numerals containing letter extensions are used to identify those components that have been modified.

Vapor-injection system 80*b* includes a vapor-injection tube 82*b* having a passageway 88*b*, a seal assembly 84*b*, and a shell fitting 86. Tube 82*b* is fixed to non-orbiting scroll member 66 such that passageway 88*b* is in fluid communication with passageway 90 and port 94. Passageway 88*b* is also in fluid communication with a bore 98*b* of main bearing housing 24*b* to allow bore 98*b* to be in fluid communication with passageway 90 and port 94 of non-orbiting scroll member 66.

Seal assembly 84*b* is generally disposed between tube 82*b* and an internal surface 114 of main bearing housing 24*b* defining bore 98*b* to maintain fluid communication therebetween when non-orbiting scroll member 66 is caused to move axially or radially relative to orbiting scroll member 54. Seal assembly 84*b* includes a gasket 96*b* disposed in an axial recess 112 formed in an outer diameter portion of tube 82. Gasket 96*b* maintains sealing engagement with internal surface 114 of bore 98*b* and may be any suitable seal such as, but not limited to, a rubber O-ring and the like. Bore 98*b* is in fluid communication with a passageway 104 of shell fitting 86 to allow intermediate-pressure vapor to enter compressor 10*b* from economizer heat exchanger or flash tank 106.

Vapor-injection system 80*b* further includes an upper seal assembly 116 having a top seal 118 and an intermediate seal 120. Top seal 118 includes a passageway 122 and intermediate seal 120 includes a passageway 124. Passageways 122, 124 are in fluid communication with each other and are in fluid communication with passageways 88*b* and 90. Top seal 118 and intermediate seal 120 cooperate with tube 82*b* to provide a sealed relationship between tube 82*b* and non-orbiting scroll member 66 and therefore ensure fluid communication between bore 98*a* and non-orbiting scroll member 66.

In operation, non-orbiting scroll member 66 may be caused to move axially or radially relative to orbiting scroll member 54 due to forces associated with compression. Gasket 96*b* allows tube 82*b* to move axially with non-orbiting scroll member 66 and still maintain a sealed relationship between passageway 88*b* of tube 82*b* and bore 98*b* of main bearing housing 24*b*. For example, if non-orbiting scroll member 66 causes tube 82*b* to move axially relative to bore 98*b* of main bearing housing 24*b*, gasket 96*b* maintains engagement with surface 110 of bore 98*a* to ensure that passageway 88*b* maintains a sealed fluid communication with bore 98*b*. Therefore, during axial movement of non-orbiting scroll member 66 relative to orbiting scroll member 54, intermediate-pressure vapor may still be delivered to pocket 92 via shell fitting 86, bore 98*b*, tube 82*b*, passageway 90, and port 94.

Gasket 96*b* also allows radial movement of tube 82*b* within bore 98*b* of main bearing housing 24*b* to accommodate radial movement of non-orbiting scroll member 66 relative to orbiting scroll member 54. During such movement, gasket 96*b* is compressed between recess 112 and internal surface 114 by the radial movement of tube 82*b* but maintains sealed fluid communication between passageway 88*b* of tube 82*b* and bore 98*b* of main bearing housing 24*b*.

Figure 5A:
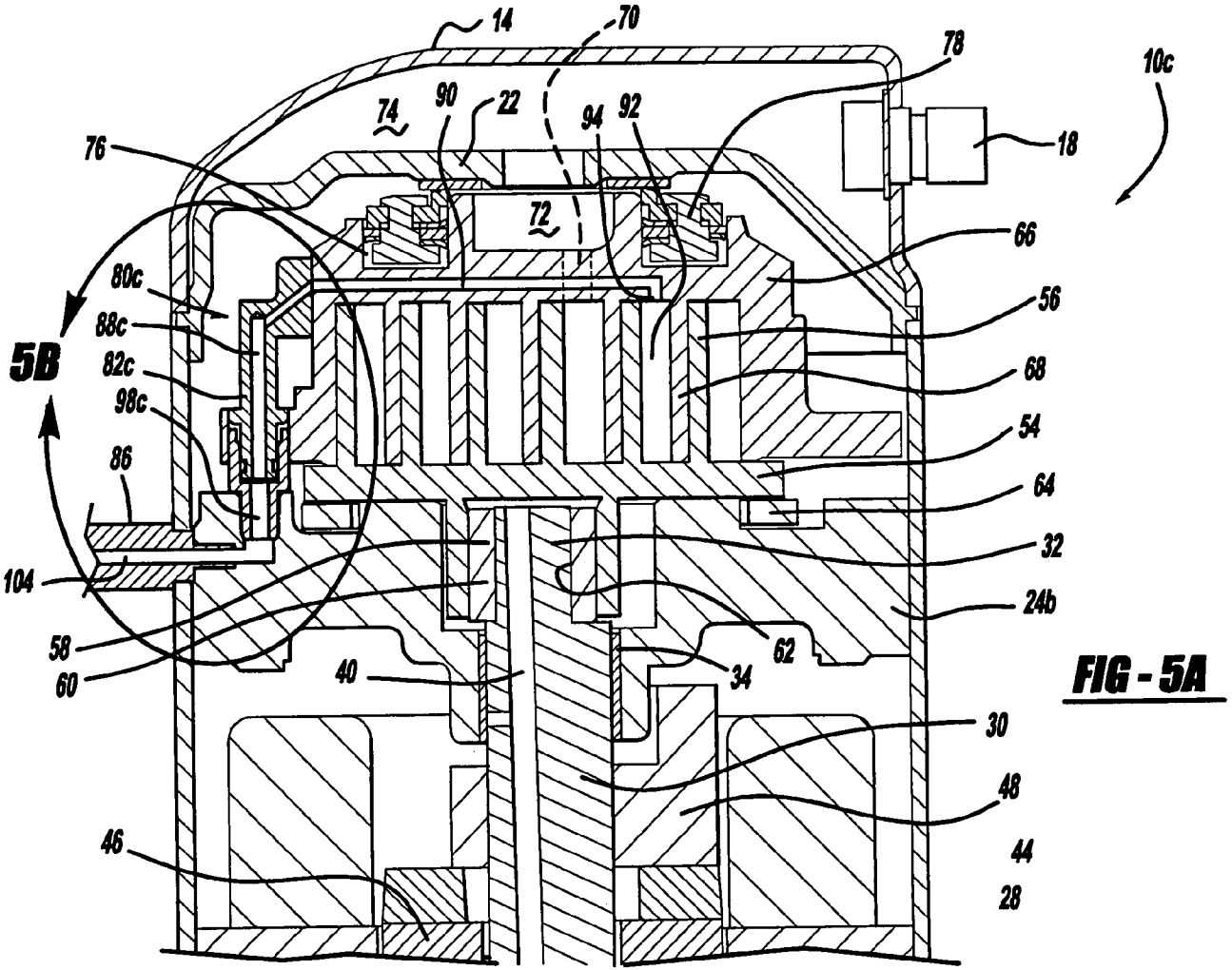
FIG. 5A is a cross-sectional view of a compressor incorporating a vapor-injection system in accordance with the principles of the present teachings.
Figure 5B:
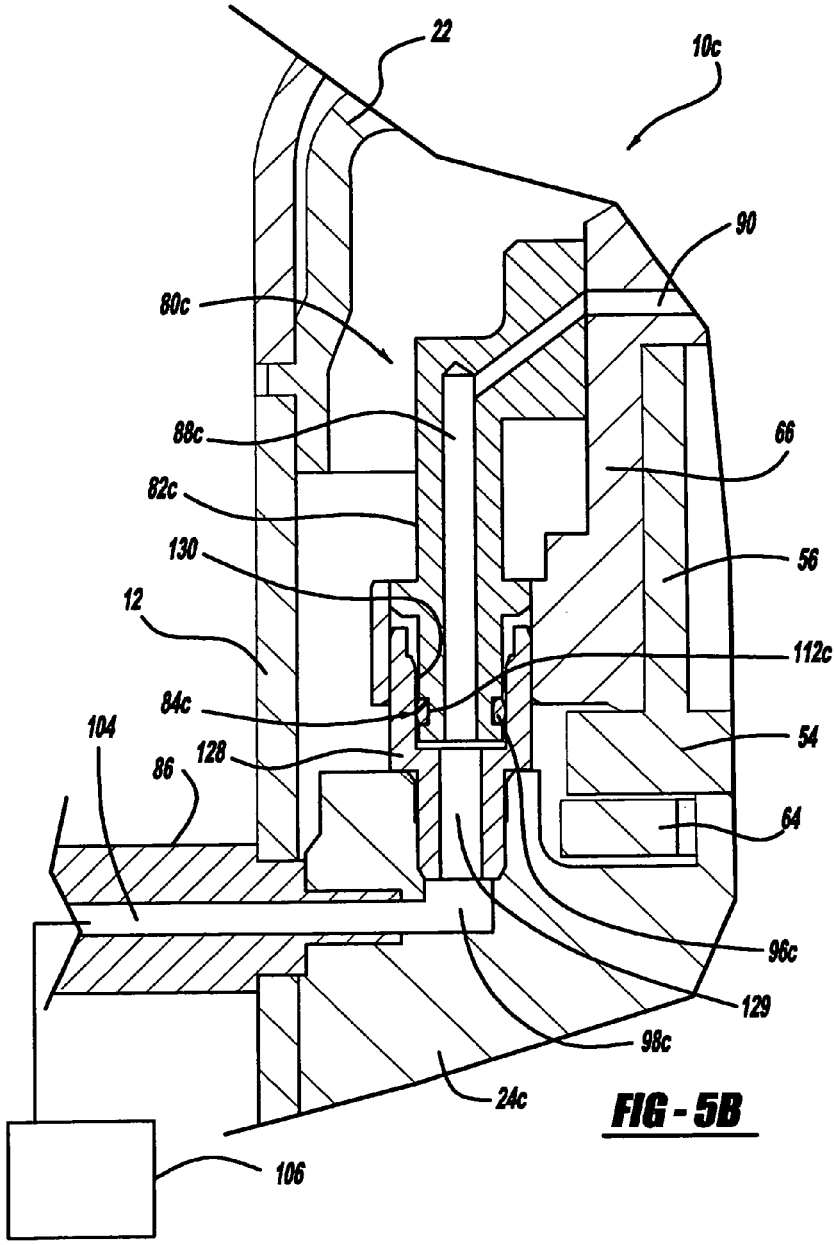
FIG. 5B is a more detailed view of the vapor-injection system of FIG. 5A.

With particular reference to FIGS. 5A and 5B, a vapor-injection system 80*c* is provided. In view of the general similarity in structure and function of the components associated with vapor-injection system 80 with respect to the vapor-injection system 80*c*, like reference numerals are used hereinafter and in the drawings to identify like components while like reference numerals containing letter extensions are used to identify those components that have been modified.

Vapor-injection system 80*c* includes a vapor-injection tube 82*c* having a passageway 88*c*, a seal assembly 84*c*, and a shell fitting 86. Tube 82*c* is fixed to non-orbiting scroll member 66 such that passageway 88*c* is in fluid communication with passageway 90 and port 94. Passageway 88*c* is also in fluid communication with a bore 98*c* of main bearing housing 24*c* to allow bore 98*b* to be in fluid communication with passageway 90 and port 94 of non-orbiting scroll member 66.

Seal assembly 84*c* is generally disposed between tube 82*c* and a sleeve tube 128 that is fixedly attached to bore 98*c*. Sleeve tube 128 includes a passageway 129 in fluid communication with passageway 88*c* of tube 82*c* and with bore 98*c* of main bearing housing 24*c*. Once tube 82*c* is inserted into sleeve tube 128, fluid communication between tube 82*c* and main bearing housing 24*c* is accomplished via bore 98*c* and passageways 129 and 88*c*.

Seal assembly 84*c* and tube 82*c* cooperate to maintain fluid communication between bore 98*c* of main bearing housing 24*c* and passageways 129 and 88*c* of tube 82*c* when non-orbiting scroll member 66 is caused to move axially or radially relative to orbiting scroll member 54. Seal assembly 84*c* includes a gasket 96*c* disposed in an axial recess 112*c* of tube 82*c*. Gasket 96*c* is in sealing engagement with an internal surface 130 of sleeve tube 128 and may be any suitable seal such as, but not limited to, a rubber O-ring and the like. Bore 98*c* is in fluid communication with a passageway 104 of shell fitting 86 to allow intermediate-pressure vapor to enter compressor 10*c* from economizer heat exchanger or flash tank 106.

In operation, non-orbiting scroll member 66 may be caused to move axially or radially relative to orbiting scroll member 54 due to forces associated with compression. Gasket 96*c* allows tube 82*c* to move axially with non-orbiting scroll member 66 and still maintain a sealed relationship between passageway 88*c* of tube 82*c* and bore 98*c* of main bearing housing 24*c*. For example, if non-orbiting scroll member 66 is caused to axially move relative to main bearing housing 24*c*, gasket 96*c* maintains engagement with surface 130 of sleeve tube 128 to ensure that passageway 88*c* remains in a sealed relationship with bore 98*c* of main bearing housing 24*c*. Therefore, during movement of non-orbiting scroll member 66 relative to orbiting scroll member 54, intermediate-pressure vapor may still be delivered to pocket 92 via shell fitting 86, sleeve tube 128, bore 98*c*, tube 82*c*, passageway 90, and port 94.

Gasket 96*c* also allows radial movement of tube 82*c* relative to main bearing housing 24*c* to accommodate radial movement of non-orbiting scroll member 66 relative to orbiting scroll member 54. During such movement, gasket 96*c* is compressed between recess 112*c* and internal surface 130 by the radial movement of tube 82*c* within sleeve tube 128 but maintains sealed fluid communication between tube 82*c* and main bearings housing 24*c*.

Figure 6A:
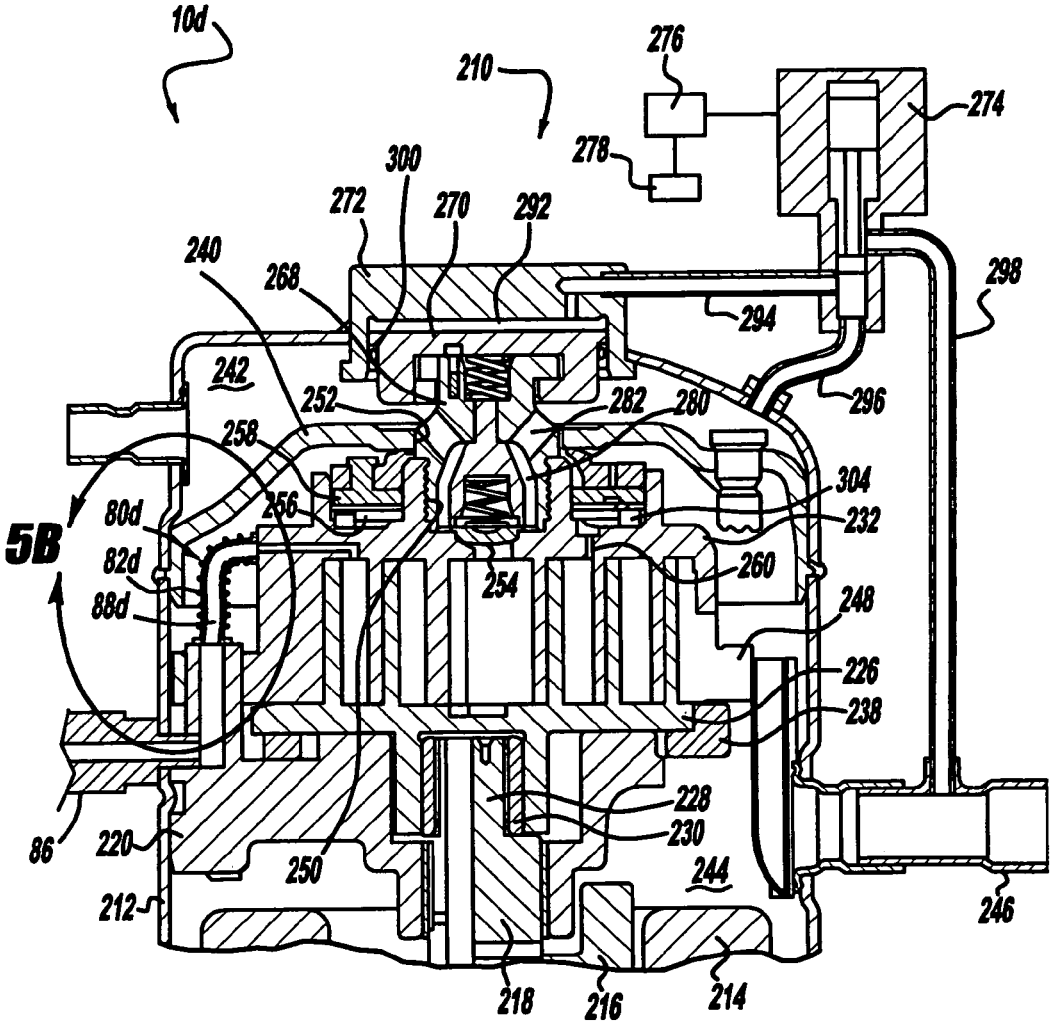
FIG. 6A is a cross-sectional view of a compressor incorporating a vapor-injection system in accordance with the principles of the present teachings.
Figure 6B:
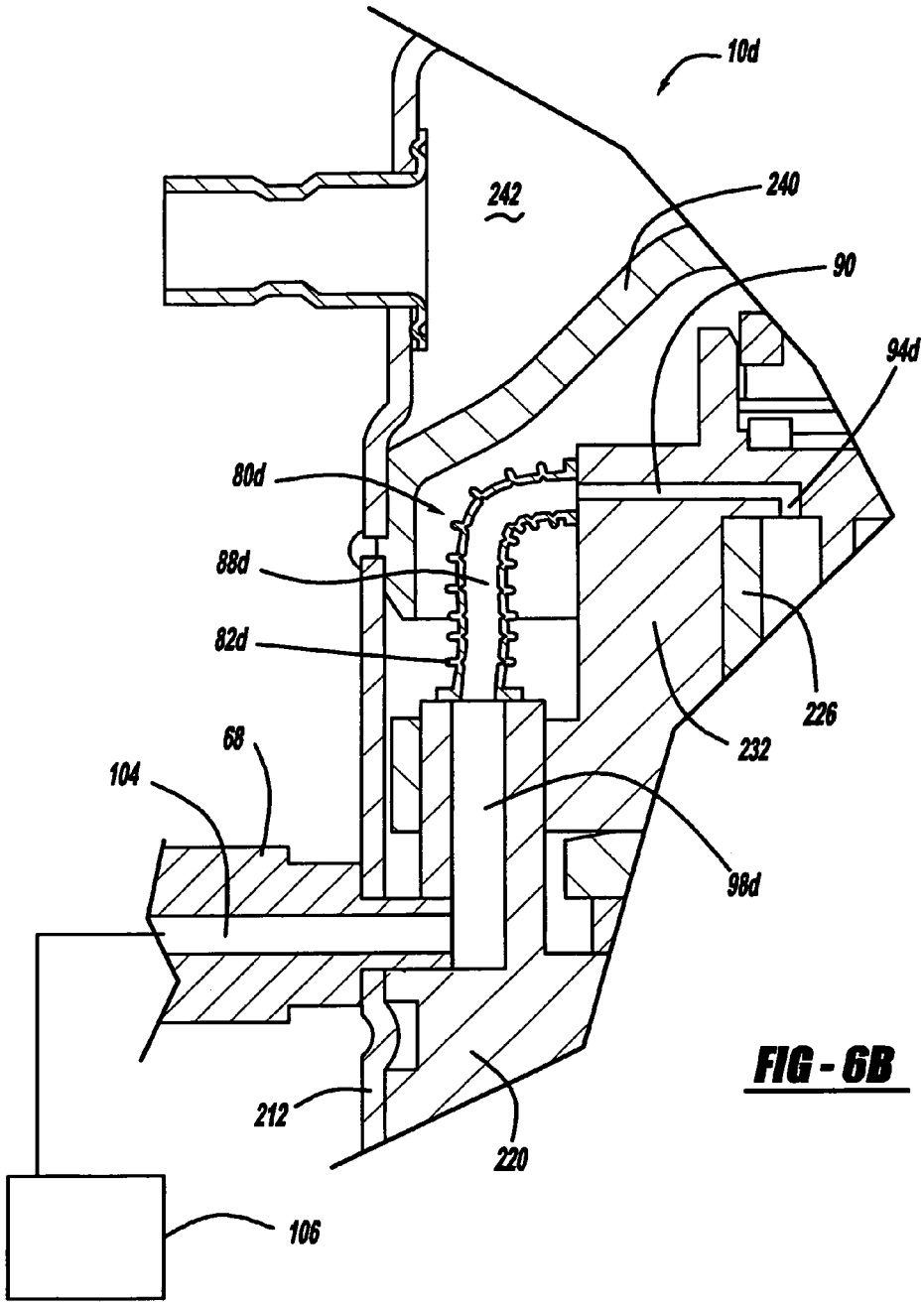
FIG. 6B is a more detailed view of the vapor-injection system of FIG. 6A.

With reference to FIGS. 6A and 6B, a compressor 10*d* incorporating a vapor-injection system 80*d* and a capacity-control system 210 is provided. Scroll compressor 10*d* is generally of the type described in Assignee's U.S. Pat. No. 5,102,316 and capacity control system 210 is preferably of the type described in Assignee's U.S. Pat. No. 6,213,731, the disclosures of which are incorporated herein by reference. Scroll compressor 10*d* includes an outer shell 212 within which is disposed a motor including a stator 214 and a rotor 216, a crankshaft 218 to which rotor 216 is secured, an upper bearing housing 220 and a lower bearing housing (not shown) for rotatably supporting crankshaft 218.

Compressor 10*d* includes an orbiting scroll member 226 supported on upper bearing housing 220 and drivingly connected to crankshaft 218 via a crankpin 228 and a drive bushing 230. A non-orbiting scroll member 232 is positioned in meshing engagement with orbiting scroll member 226 and is axially movably secured to the upper bearing housing 220. An Oldham coupling 238 cooperates with scroll members 226 and 232 to prevent relative rotation therebetween. A partition plate 240 adjacent the upper end of shell 212 serves to divide the interior of shell 212 into a discharge chamber 242 at the upper end thereof and a suction chamber 244 at the lower end thereof.

In operation, as orbiting scroll member 226 orbits with respect to non-orbiting scroll member 232, suction gas is drawn into suction chamber 244 of shell 212 via a suction fitting 246. From suction chamber 244, suction gas is sucked into compressor 10*d* through an inlet 248 provided in non-orbiting scroll member 232. The intermeshing scroll wraps of scroll members 226 and 232 define moving pockets of gas that progressively decrease in size as they move radially inwardly as a result of the orbiting motion of orbiting scroll member 226, thus compressing the suction gas entering via inlet 248. The compressed gas is then discharged into discharge chamber 242 through a hub 250 provided in non-orbiting scroll member 232 and a passage 252 formed in partition 240. A pressure responsive discharge valve 254 is preferably provided seated within hub 250.

Non-orbiting scroll member 232 is also provided with an annular recess 256 formed in the upper surface thereof. A floating seal 258 disposed within recess 256 is biased by intermediate pressurized gas against partition 240 to seal suction chamber 244 from discharge chamber 242. A passage 260 extends through non-orbiting scroll member 232 to supply intermediate-pressure gas to recess 256.

Capacity-control system 210 further includes a discharge fitting 268, a piston 270, a shell fitting 272, a three-way solenoid valve 274, a control module 276, and a sensor array 278 having one or more appropriate sensors. Discharge fitting 268 is threadingly received or otherwise secured within hub 250. Discharge fitting 268 defines an internal cavity 280 and a plurality of discharge passages 282. Discharge valve 254 is disposed within cavity 280. Thus, pressurized gas overcomes the biasing load of discharge valve 254 to open discharge valve 254 and allow the pressurized gas to flow into cavity 280, through passages 282 and into discharge chamber 242.

Shell fitting 272 is sealingly secured to shell 212 and slidingly receives piston 270. Piston 270 and shell fitting 272 define a pressure chamber 292. Pressure chamber 292 is fluidly connected to solenoid valve 274 by a tube 294. Solenoid valve 274 is in fluid communication with discharge chamber 242 through a tube 296 and with suction fitting 246. Solenoid valve 274 is also in fluid communication with suction chamber 244 through a tube 298. A seal 300 is located between piston 270 and shell fitting 272. The combination of piston 270, seal 300, and shell fitting 272 provides a self-centering sealing system to provide accurate alignment between piston 270 and shell fitting 272.

In order to bias non-orbiting scroll member 232 into sealing engagement with orbiting scroll member 226 for normal full load operation, solenoid valve 274 is deactivated (or actuated) by control module 276 such that discharge chamber 242 is in direct communication with chamber 292 through tube 296, solenoid valve 274, and tube 294. The pressurized fluid at discharge pressure within chambers 242 and 292 acts against opposite sides of piston 270 allowing for normal biasing of non-orbiting scroll member 232 towards orbiting scroll member 226 to sealingly engage the axial ends of each scroll member with the respective end plate of the opposite scroll member. The axial sealing of the two scroll members 226 and 232 causes compressor 10*d* to operate at one-hundred percent capacity.

In order to unload compressor 10*d*, solenoid valve 274 is actuated (or deactuated) by control module 276 such that suction chamber 244 is in direct communication with chamber 292 through suction fitting 246, tube 298, solenoid valve 274, and tube 294. With the discharge pressure pressurized fluid released to suction from chamber 292, the pressure differences on opposite sides of piston 270 moves non-orbiting scroll member 232 upward to separate the axial ends of the tips of each scroll member with its respective end plate to create a gap, which allows the higher pressurized pockets to bleed to the lower pressurized pockets and eventually to suction chamber 244. A wave spring 304 maintains the sealing relationship between floating seal 258 and partition 240 during the modulation of non-orbiting scroll member 232. The creation of the gap substantially eliminates continued compression of the suction gas. When this unloading occurs, discharge valve 254 moves to its closed position, thereby preventing the backflow of high pressurized fluid from discharge chamber 242 or the downstream refrigeration system. When compression of the suction gas is to be resumed, solenoid valve 274 is deactuated (or actuated) in which fluid communication between chamber 292 and discharge chamber 242 is again created. This again allows fluid at discharge pressure to react against piston 270 to axially engage scroll members 226 and 232. The axial sealing engagement recreates the compressing action of compressor 10*d*.

Control module 276 is in communication with sensor array 278 to provide the required information for control module 276 to determine the degree of unloading required for the particular conditions of the refrigeration system including scroll compressor 10*d* existing at that time. Based upon this information, control module 276 operates solenoid valve 274 in a pulsed width modulation mode to alternately place chamber 292 in communication with discharge chamber 242 and suction chamber 244. The frequency with which solenoid valve 274 is operated in the pulsed width modulated mode determines the percent capacity of operation of compressor 10*d*. As the sensed conditions change, control module 276 varies the frequency of operation for solenoid valve 274 and thus the relative time periods at which compressor 10*d* is operated in a loaded and unloaded condition. The varying of the frequency of operation of solenoid valve 274 can cause the operation of compressor between fully loaded or one hundred percent capacity and completely unloaded or zero percent capacity or at any of an infinite number of settings in between in response to system demands.

With continued reference to FIGS. 6A and 6B, a vapor-injection system 80*d* is provided. In view of the general similarity in structure and function of the components associated with vapor-injection system 80 with respect to the vapor-injection system 80*d*, like reference numerals are used hereinafter and in the drawings to identify like components while like reference numerals containing letter extensions are used to identify those components that have been modified.

Vapor-injection system 80*d* includes a flexible tube 82*d* having a passageway 88*d* and a shell fitting 86. Tube 82*d* may be formed from clear and/or braided reinforced PVC, as well as low- and high-density polyethylene, polypropylene, polyurethane, or nylon, among other materials. Tube 82*d* is fixed to non-orbiting scroll member 232 such that passageway 88*d* is in fluid communication with passageway 90 and port 94*d*. The tube 82*d* may be attached to a side of the non-orbiting scroll member 232 such that an end of the tube 82*d* extends from the non-orbiting scroll member 232 in a direction generally perpendicular to a direction of axial movement of the non-orbiting scroll member 232 relative to the orbiting scroll member 226, as shown in FIG. 6B. Passageway 88*d* is also in fluid communication with a bore 98*d* formed in main bearing housing 220 to allow bore 98*d* to be in sealed fluid communication with passageway 90 and port 94*d* of non-orbiting scroll member 232.

In operation, non-orbiting scroll member 232 may be caused to move axially or radially relative to orbiting scroll member 226 due to forces associated with compression. Tube 82*d* allows non-orbiting scroll member 232 to move axially or radially relative to orbiting scroll member 226 and still maintain sealed communication between passageway 88*d* of tube 82*d* and bore 98*d* of main bearing housing 220 due to the flexible nature of tube 82*d*. Therefore, vapor injection is permitted during periods when capacity control system 210 axially moves non-orbiting scroll member 232 relative to main bearing housing 220 to adjust a capacity of compressor 10*d*.

As described, tube 82*d* is able to accommodate both axial and radial movement of non-orbiting scroll member 232 relative to orbiting scroll member 226 to maintain fluid communication between an economizer heat exchanger or flash tank 106 and a pocket between orbiting and non-orbiting scroll members 226, 232. Such movement of non-orbiting scroll member 232 is frequent when a capacity control system such as system 210 is incorporated into compressor 10*d* as system 210 seeks to axially move non-orbiting scroll member 232 to modulate a capacity of compressor 10*d*. It should be understood that while vapor-injection system 80*d* is described as being associated with compressor 10*d*, any of the foregoing vapor-injection systems 80, 80*a*, 80*b*, 80*c* may similarly be incorporated into compressor 10*d* for use in conjunction with capacity control system 210.

The description of the teachings is merely exemplary in nature and, thus, variations are intended to be within the scope of the teachings. Such variations are not to be regarded as a departure from the spirit and scope of the teachings.

What is claimed is:

1. A scroll compressor comprising:

a housing;

a non-orbiting scroll member including a first end plate and a first spiral wrap upstanding therefrom, said non-orbiting scroll member being axially movable relative to said housing;

an orbiting scroll member including a second end plate and a second spiral wrap upstanding therefrom, said first and second spiral wraps being interleaved to define a moving fluid pocket that decreases in size as it moves from a radially outer position to a radially inner position;

a main bearing housing supporting said orbiting scroll member and including a fluid passageway;

a tube having an axis extending along its length and fixed for axial movement along said axis with said non-orbiting scroll member and in fluid communication with said fluid passageway; and a port formed in said non-orbiting scroll member and in fluid communication with said tube to inject vapor into said at least one moving fluid pocket.

2. The scroll compressor of claim 1, further comprising a seal disposed between said tube and said main bearing housing.

3. The scroll compressor of claim 2, wherein said seal includes a flat top seal disposed between an end of said tube and an opening of said fluid passageway of said main bearing housing.

4. The scroll compressor of claim 2, wherein said seal includes a gasket in contact with said tube to seal said tube to said fluid passageway of said main bearing housing.

5. The scroll compressor of claim 4, wherein said gasket is an O-ring.

6. The scroll compressor of claim 4, wherein said gasket is disposed in an annular recess formed in said fluid passageway of said main bearing housing.

7. The scroll compressor of claim 4, wherein said gasket is disposed in an annular recess formed in said tube.

8. The scroll compressor of claim 1, further comprising a sleeve tube disposed in, and in fluid communication with, said fluid passageway.

9. The scroll compressor of claim 8, wherein said sleeve tube slidably receives said tube.

10. The scroll compressor of claim 9, further comprising a seal disposed between said sleeve tube and said tube.

11. The scroll compressor of claim 10, wherein said seal includes a gasket in contact with said tube to seal said tube to said fluid passageway of said main bearing housing.

12. The scroll compressor of claim 11, wherein said gasket is an O-ring.

13. The scroll compressor of claim 11, wherein said gasket is disposed in an annular recess formed in said fluid passageway of said main bearing housing.

14. The scroll compressor of claim 11, wherein said gasket is disposed in an annular recess formed in said tube.

15. The scroll compressor of claim 14, wherein said sleeve tube includes a stop for limiting axial movement of said tube.

16. The scroll compressor of claim 14, wherein said tube includes a stop for engaging said sleeve tube to limit axial movement of said tube.

17. The scroll compressor of claim 1, further comprising a first seal disposed between said tube and said non-orbiting scroll member.

18. The scroll compressor of claim 17, further comprising a second seal disposed between said tube and said non-orbiting scroll member.

19. The scroll compressor of claim 1, further comprising a capacity modulation system.

20. The scroll compressor of claim 19, wherein said capacity modulation system includes a valve that selectively moves said non-orbiting scroll member from said orbiting scroll member to adjust a capacity of the scroll compressor.

21. The scroll compressor of claim 20, wherein said valve is a solenoid valve.

22. The scroll compressor of claim 1, further comprising a shell fitting extending through said housing and in fluid communication with said fluid passageway.

23. The scroll compressor of claim 1, further comprising a seal disposed between said tube and said non-orbiting scroll member that permits axial and radial movement of said non-orbiting scroll member relative to said housing.

24. The scroll compressor of claim 1, wherein said tube is directly attached to said non-orbiting scroll member.

25. A scroll compressor comprising:

a housing;

a non-orbiting scroll member including a first end plate and a first spiral wrap upstanding therefrom, said non-orbiting scroll member being axially movable relative to said housing;

an orbiting scroll member including a second end plate and a second spiral wrap upstanding therefrom, said first and second spiral wraps being interleaved to define a moving fluid pocket that decreases in size as it moves from a radially outer position to a radially inner position;

a main bearing housing supporting said orbiting scroll member and including a fluid passageway;

a tube having an axis extending along its length and fixed to said non-orbiting scroll member for movement along said axis and in a direction towards and away from said orbiting scroll member, said tube being in fluid communication with said fluid passageway; and a port formed in said non-orbiting scroll member and in fluid communication with said tube to inject vapor into said at least one moving fluid pocket.

26. The scroll compressor of claim 25, further comprising a seal disposed between said tube and said main bearing housing.

27. The scroll compressor of claim 26, wherein said seal includes a flat top seal disposed between an end of said tube and an opening of said fluid passageway of said main bearing housing.

28. The scroll compressor of claim 26, wherein said seal includes a gasket in contact with said tube to seal said tube to said fluid passageway of said main bearing housing.

29. The scroll compressor of claim 28, wherein said gasket is disposed in an annular recess formed in said fluid passageway of said main bearing housing.

30. The scroll compressor of claim 25, further comprising a sleeve tube disposed in, and in fluid communication with, said fluid passageway.

31. The scroll compressor of claim 30, wherein said sleeve tube slidably receives said tube.

32. The scroll compressor of claim 25, further comprising a capacity modulation system.

33. The scroll compressor of claim 25, further comprising a seal disposed between said tube and said non-orbiting scroll member that permits axial and radial movement of said non-orbiting scroll member relative to said housing.

34. The scroll compressor of claim 1, wherein said tube is fixed for radial movement with said non-orbiting scroll member.

35. The scroll compressor of claim 34, wherein said tube remains in sealed fluid communication with said fluid passageway during axial and radial movement of said non-orbiting scroll member.

36. The scroll compressor of claim 25, wherein said tube is fixed for radial movement with said non-orbiting scroll member.

37. The scroll compressor of claim 36, wherein said tube remains in sealed fluid communication with said fluid passageway during axial and radial movement of said non-orbiting scroll member.

38. The scroll compressor of claim 1, wherein said port is in direct fluid communication with said tube.

39. The scroll compressor of claim 25, wherein said port is in direct fluid communication with said tube.

40. The scroll compressor of claim 1, wherein said tube extends into said fluid passageway.

41. The scroll compressor of claim 25, wherein said tube extends from said first end plate a greater distance than said first spiral wrap.

42. A scroll compressor comprising:

a housing;

a non-orbiting scroll member including a first end plate and a first spiral wrap upstanding therefrom, said non-orbiting scroll member being axially movable relative to said housing;

an orbiting scroll member including a second end plate and a second spiral wrap upstanding therefrom, said first and second spiral wraps being interleaved to define a moving fluid pocket that decreases in size as it moves from a radially outer position to a radially inner position;

a main bearing housing supporting said orbiting scroll member and including a fluid passageway;

a rigid tube fixed for axial movement with said non-orbiting scroll member and in fluid communication with said fluid passageway; and a port formed in said non-orbiting scroll member and in fluid communication with said tube to inject vapor into said at least one moving fluid pocket.

43. The scroll compressor of claim 42, further comprising a seal disposed between said tube and said main bearing housing.

44. The scroll compressor of claim 43, wherein said seal includes a flat top seal disposed between an end of said tube and an opening of said fluid passageway of said main bearing housing.

45. The scroll compressor of claim 43, wherein said seal includes a gasket in contact with said tube to seal said tube to said fluid passageway of said main bearing housing.

46. The scroll compressor of claim 45, wherein said gasket is disposed in an annular recess formed in one of said fluid passageway of said main bearing housing and an annular recess formed in said tube.

47. The scroll compressor of claim 42, further comprising a sleeve tube disposed in, and in fluid communication with, said fluid passageway.

48. The scroll compressor of claim 42, further comprising a first seal disposed between said tube and said non-orbiting scroll member.

49. The scroll compressor of claim 48, further comprising a second seal disposed between said tube and said non-orbiting scroll member.

50. The scroll compressor of claim 42, further comprising a capacity modulation system.

51. The scroll compressor of claim 50, wherein said capacity modulation system includes a valve that selectively moves said non-orbiting scroll member from said orbiting scroll member to adjust a capacity of the scroll compressor.

52. The scroll compressor of claim 42, further comprising a seal disposed between said tube and said non-orbiting scroll member that permits axial and radial movement of said non-orbiting scroll member relative to said housing.

53. The scroll compressor of claim 42, wherein said tube is directly attached to said non-orbiting scroll member.

54. A scroll compressor comprising:

a housing;

a non-orbiting scroll member including a first end plate and a first spiral wrap upstanding therefrom, said non-orbiting scroll member being axially movable relative to said housing;

an orbiting scroll member including a second end plate and a second spiral wrap upstanding therefrom, said first and second spiral wraps being interleaved to define a moving fluid pocket that decreases in size as it moves from a radially outer position to a radially inner position;

a main bearing housing supporting said orbiting scroll member and including a fluid passageway;

a rigid tube fixed to said non-orbiting scroll member for movement in a direction towards and away from said orbiting scroll member, said tube being in fluid communication with said fluid passageway; and a port formed in said non-orbiting scroll member and in fluid communication with said tube to inject vapor into said at least one moving fluid pocket.

55. The scroll compressor of claim 54, further comprising a seal disposed between said tube and said main bearing housing.

56. The scroll compressor of claim 55, wherein said seal includes a flat top seal disposed between an end of said tube and an opening of said fluid passageway of said main bearing housing.

57. The scroll compressor of claim 55, wherein said seal includes a gasket in contact with said tube to seal said tube to said fluid passageway of said main bearing housing.

58. The scroll compressor of claim 57, wherein said gasket is disposed in an annular recess formed in one of said fluid passageway of said main bearing housing and an annular recess formed in said tube.

59. The scroll compressor of claim 54, further comprising a sleeve tube disposed in, and in fluid communication with, said fluid passageway.

60. The scroll compressor of claim 54, further comprising a first seal disposed between said tube and said non-orbiting scroll member.

61. The scroll compressor of claim 60, further comprising a second seal disposed between said tube and said non-orbiting scroll member.

62. The scroll compressor of claim 54, further comprising a capacity modulation system.

63. The scroll compressor of claim 62, wherein said capacity modulation system includes a valve that selectively moves said non-orbiting scroll member from said orbiting scroll member to adjust a capacity of the scroll compressor.

64. The scroll compressor of claim 54, further comprising a seal disposed between said tube and said non-orbiting scroll member that permits axial and radial movement of said non-orbiting scroll member relative to said housing.

65. The scroll compressor of claim 54, wherein said tube is directly attached to said non-orbiting scroll member.

* * * * *

UNITED STATES PATENT AND TRADEMARK OFFICE

CERTIFICATE OF CORRECTION

PATENT NO. : 7,815,423 B2
APPLICATION NO. : 11/494270
DATED : October 19, 2010
INVENTOR(S) : Huaming Guo et al.

It is certified that error appears in the above-identified patent and that said Letters Patent is hereby corrected as shown below:

| | |
|---|---|
| Column 1, Line 48 | "injections" should be --injection--. |
| Column 2, Line 1 | "potion" should be --portion--. |
| Column 3, Line 13 | "therefrom" should be --from--. |
| Column 3, Line 67 | "respectively" should be --respective--. |
| Column 4, Line 51 | "self 100" should be --shelf 100--. |
| Column 4, Line 60 | After "relative", insert --to--. |
| Column 6, Line 19 | "bearings" should be --bearing--. |
| Column 8, Line 11 | "bearings" should be --bearing--. |

Signed and Sealed this
Sixteenth Day of August, 2011

David J. Kappos

David J. Kappos
*Director of the United States Patent and Trademark Office*